United States Patent [19]

Vaice

[11] Patent Number: 4,854,238

[45] Date of Patent: Aug. 8, 1989

[54] SHARK PROJECTILE

[76] Inventor: Sam A. Vaice, 752 Gettysburg Way, Gilroy, Calif. 95020

[21] Appl. No.: 192,455

[22] Filed: May 11, 1988

[51] Int. Cl.[4] ..... F41C 9/06; A01K 81/00; F42B 15/24

[52] U.S. Cl. ..... 102/371; 42/114; 102/399

[58] Field of Search ..... 102/371, 399; 42/1.14; 43/6

[56] References Cited

U.S. PATENT DOCUMENTS

| | | | |
|---|---|---|---|
| 17,312 | 5/1857 | Brand | 102/371 |
| 46,437 | 2/1865 | Barker | 42/1.14 |
| 763,147 | 6/1904 | Brown | 102/371 |
| 3,417,719 | 12/1968 | Nitenson | 42/1.14 |

FOREIGN PATENT DOCUMENTS

| | | | |
|---|---|---|---|
| 2252215 | 5/1974 | Fed. Rep. of Germany | 42/1.14 |
| 682964 | 11/1952 | United Kingdom | 102/371 |
| 785840 | 11/1957 | United Kingdom | 102/371 |

*Primary Examiner*—Deborah L. Kyle
*Assistant Examiner*—Michael J. Carone
*Attorney, Agent, or Firm*—Townsend and Townsend

[57] ABSTRACT

A projectile having a tubular projectile body and provided with pointed fins pivotally mounted at the front end of the projectile body. The head fins expand when the projectile strikes a target shark to prevent the projectile from passing clear through the shark and to present a wound which is covered by a searing agent which is released from the interior of the body when the projectile strikes the target. The searing agent sears the wound, eliminating bleeding which attracts predators. Several embodiments of the projectile are disclosed.

7 Claims, 1 Drawing Sheet

FIG.1a
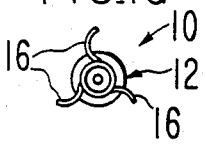
FIG.1
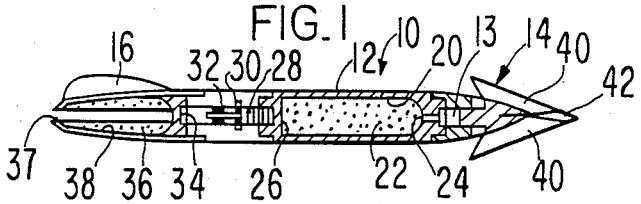
FIG.2a
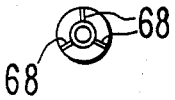
FIG.2
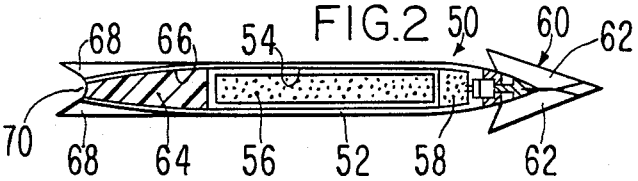
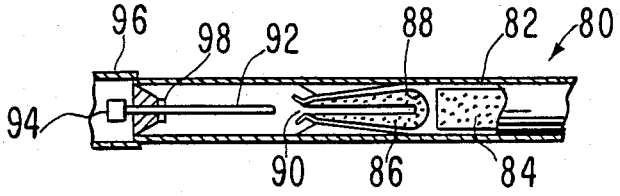
FIG.3
FIG.4a
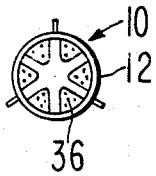
FIG.4b
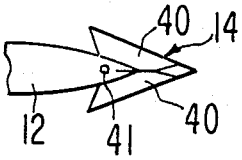
FIG.4c
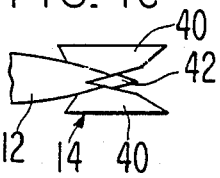
FIG.4d
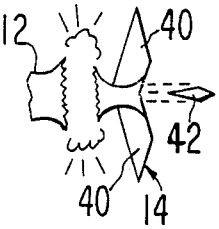
FIG.5
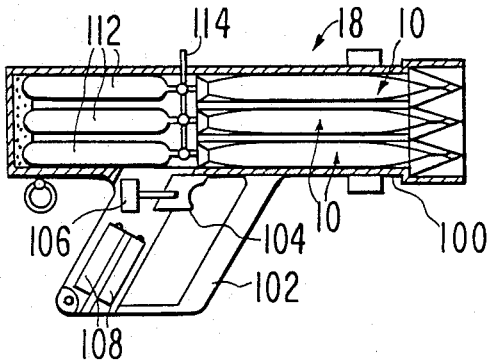
FIG.5a
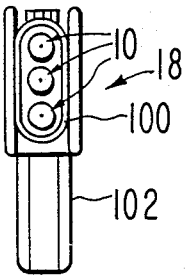
FIG.5b
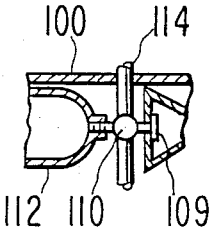
FIG.6
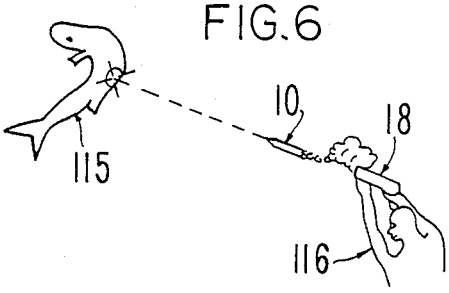

SHARK PROJECTILE

BACKGROUND OF THE INVENTION

1. Field of the Invention

This invention relates to improvements in lethal weapons for use in killing animals and fish and, more particularly, to an improved projectile for killing sharks.

2. Description of the Prior Art

It is often desirable or necessary to arm oneself against the attacks of shark in shark-infested waters. Such protection is needed by divers who must work in such areas for one or more reasons. Sharks can be very dangerous, and a person in shark-infested waters must be well-armed or otherwise protected against shark attacks in such regions. While spears, lances and other weapons have been used against sharks during an attack, such weapons have limitations which make them less desirable and of questionable protection for use against sharks. Thus, a need has continued to exist for improvements in weapons usable in such dire circumstances where a shark attacks a diver and the diver must have almost instant retaliation capabitilies to prevent being killed himself. The present invention satisfies this need.

SUMMARY OF THE INVENTION

The present invention is directed to a projectile which is simple and rugged in construction, and can be launched almost immediately after sensing the presence of a shark by the user of the projectile. The projectile is provided with an explosive head to kill a shark by shock and a searing agent to prevent bleeding after the shark has been fired upon and struck with the projectile.

The shark projectile of the present invention is a weapon designed primarily for use in the various shark-infested waters of the world. It is a dangerous weapon. In its present design, it can be launched by gas or by a solid propellant which is ignited. It is designed for a short range; however, it can be adapted for long range use and for other functions.

The basic aspect of the present invention is that the projectile can be fired accurately without danger to the person firing the projectile. Also, the projectile will have a very fast response time for underwater usage.

The projectile is designed to penetrate the hide of a target shark and, with a pivotal design of the head of the projectile, the head is intended to keep the projectile from passing clear through the target shark while creating in the shark a massive internal wound. The searing agent, such as magnesium in coil form, carried by the projectile will sear the wound, thereby eliminating the bleeding which attracts predators in the region at which the shark has been fired upon. Thus, the combination of hitting power, massive internal wounding and the intense heat of the searing agent will kill the shark without necessarily hitting a vital area.

The primary object of the present invention is to provide a projectile for use in killing sharks, wherein the projectile has an expandable, explosive head and carries a searing agent so that the projectile will be able to strike the shark while creating a massive internal wound and the searing agent will eliminate bleeding of the shark to thereby avoid attracting predators, all to the end that a very efficient projectile is provided for lethal destruction of a shark in minimum of time.

Other objects of this invention will become apparent as the following specification progresses, reference being had to the accompanying drawings for an illustration of the invention.

BREIF DESCRIPTION OF THE DRAWINGS

FIG. 1 is a vertical section through a first embodiment of the projectile of the present invention;

FIG. 1a is an elevational view of the rear end of the projectile of FIG. 1;

FIG. 2 is a view similar to FIG. 1 but showing another embodiment of the projectile;

FIG. 2*a* is an end elevational view of the projectile of FIG. 2;

FIG. 3 is an enlarged, fragmentary view similar to FIGS. 1 and 2 but showing still another embodiment of the projectile of the present invention;

FIG. 4*a* is a cross-sectional view of the projectile of FIG. 3;

FIG. 4*b* is a side elevational view of a portion of the head of the embodiment of FIGS. 1–3;

FIG. 4*c* is a view similar to FIG. 4*b* but showing the head as it partially expands to create a massive wound in the hide of a shark;

FIG. 4 is a view similar to FIGS. 4*b* and 4*c* but showing the head in its fully expanded condition;

FIG. 5 is a vertical section through a projectile launcher for launching the projectiles of the present invention;

FIG. 5*a* is a front elevational view of the launcher of FIG. 5;

FIG. 5*b* is an enlarged, fragmentary, cross-sectional view of the launcher showing the way in which a gas or other projecting means can be coupled with the launcher to launch a projectile therefrom; and FIG. 6 is a prospective view showing the way in which the projectile is fired by the launcher at a shark to immobilize the shark.

DETAILED DESCRIPTION OF THE PREFERRED EMBODIMENTS

A first embodiment of the projectile of the present invention is broadly denoted by the numeral 10 and is shown in FIGS. 1 and 1*a*. Projectile 10 includes an outer, tubular body 12 having a head 14 at the front end thereof. Guiding fins 16 at the rear end of body 12 are three in number and are curved as shown in FIG. 1a to guide the projectile after it has been launched by a launcher 18 (FIG. 5).

Body 12 has a number of interconnected parts to present a first chamber 20 for receiving a searing agent 22. The searing agent chamber 20 extends from a point 24 to a point 26 forwardly of a firing pin spring 28 adjacent to a firing pin release 30 which has a firing pin 32 thereon immediately ahead of a primer cap 34 which, when energized, ignities a solid propellant 36 in a propellant chamber 38 at the rear end of the projectile adjacent to fins 16. A rear nozzle opening 37 provides an exit for propellant gases when the projectile is launched.

The head 14 of projectile 10 is an expandable head as shown in FIGS. 4*b*, 4*c* and 4*d*. To this end, the head is provided with fins 40 which are pointed at their forward ends as shown in FIG. 4*c*, which are pivoted about a pin 41 defining axes (not shown) from the non-expanded condition shown in FIG. 4*b*, through the partially expanded condition shown in FIG. 4*c* to the fully expanded condition shown in FIG. 4*d*. To this end, the head 14 includes a diamond-shaped tip 42 which, when striking the target, is forced inwardly from the position shown in FIG. 4*b* to the position shown in FIG. 4*c*, camming the fins 40 outwardly so that their pointed ends move away from each other. Finally, the head moves slightly rearwardly, detonating the explosive charge 13 and cause the head to open fully as shown in FIG. 4*d*, simultaneously during which the tip 42 is propelled forwardly by the explosive force indicated by the expanding gases 46 (FIG. 4*d*). The shark struck by the head dies almost immediately by shock.

Thus, the projectile is operable to penetrate the hide of the target to cause a wound and, with the expandable head 14, the missle is kept from exiting the other side of the target while creating a massive internal wound. When the head 14 strikes the target, the searing agent 22 is released and is allowed to cover the wound thereby eliminating the bleeding which attracts predators in the adjacent regions where the shark is hit with the projectile.

FIG. 2 shows another embodiment of a projectile denoted by the numeral 50 which includes a tubular projectile body 52 defining a chamber 54 for receiving a searing agent 56 behind an explosive charge 58 rearwardly of head 60 which is comprised of pointed fins 62 which pivot about a pin means and thereby expand in the manner shown in FIGS. 4*b*, 4c and 4d and described above with respect to the fins of head 14.

A propellant which is foam-filled and denoted by the numeral 64 is in a chamber 66 rearwardly of the chamber 54 for containing the searing agent 56, and fans 68 are provided on the rear end of body 52 for guiding purposes and for accurately guiding the projectile through the water. The propellant, when it expands, exits from the open rear end 70 of body 52.

Another embodiment of the projectile of the present invention, shown in FIG. 3 and denoted by the numeral 80 includes a tubular body 82 which contains the searing agent 84 and propellant 86 in a chamber 88 within body 82. A rear exit nozzle 90 in chamber 88 allows a gaseous propellant to exit rearwardly of body 82 when the propellant is ignited by an electrical glow electrode 92 coupled with a power supply 94 in a watertight compartment 96 at the rear end of projectile body 82. The electrode 92 is sealed by an O-ring 98 (FIG. 3) once the power supply 94 is energized to cause the glowing of electrode 92, the heat from the glow will ignite the solid propellant 86 and chamber 88 and cause the projectile to be launched. The projectile 80 of FIG. 3 will have an expandable head such as like the expandable head 14 or head 16 of FIGS. 1 and 2.

Launcher 18 as shown in FIGS. 5 and 5*a* includes a barrel 100 having space for three projectiles, one on top of another, as shown in FIG. 5. A handle 102 has a trigger 104 which is coupled with an actuator 106 associated with a pair of batteries 108 which can be used to select and control the operation of a electromechanical valve 109 coupled with a mechanical valve 110 to an air pressure source 112 for each of the projectiles, respectively, carried by the launcher 18. By selecting the proper projectile with the actuator 106, and by pulling back on the trigger 104, valve 109 is opened for the respective projectile and high pressure gas can actuate the firing pin of projectile 10 of FIG. 1 or detonate a firing cap at the rear of the propellant 64 of projectile 50 or propellant 86 of projectile 80 as shown in FIG. 3. The mechanical valve 110 is used as a safety device to require that it be opened before the projectile can be launched when trigger 104 is pulled. Stem 114 is tubular and can be used to fill the fluid containers 112 with pressurized fluid.

In use, the three projectiles are fitted into the launcher 18 as shown in FIG. 5. When it is desired to fire upon a shark 114 as shown in FIG. 6, the user 116 aims launcher 18 and pulls the trigger 104 after selecting the proper projectile by actuator 106 and by opening mechanical valve 110 of the desired projectile. The projectile is fired accurately without danger to the user 116. Also, the projectile will be very fast for underwater usage. The projectile will penetrate the hide of shark 114 and with the fold back design of the head of the projectile, this is intended to keep the projectile from exiting through the other side of the shark while creating a massive internal wound. The projectile searing agent will also be used for searing the wound, thereby eliminating the bleeding which attracts predators in the depths of the water. Thus, the combination of striking power and massive internal wounds and intense heat of the searing agent will kill without necessarily hitting a vital area.

I claim:

1. A shark projectile comprising:

a tubular body having a front end and a rear end;

an explosive head having pointed segments at the front end of the body, there being means on the body for pivotally mounting the segments on the body to move from a pointed configuration with the head segments adjacent to each other to an expanded configuration with the segments extending away from each other, said segments being movable into said expanded configuration when the head penetrates a shark, whereby the segments keep the body from passing through the shark;

means defining a first chamber in the body, said first chamber containing a searing agent to sear the wound in a shark caused by the head entering the shark to thereby eliminate bleeding of the wound, said first chamber having means for opening the first chamber to release the searing agent therefrom when the head enters a shark;

means defining a second chamber in the body, said second chamber including a propellant and a rear exit nozzle near the rear end of the body; and means coupled with the body for releasing the propellant in a gaseous form to cause the body to be launched and to move toward a target.

2. A projectile as set forth in claim 1, wherein the searing agent is in the body near the head thereof.

3. A projectile as set forth in claim 1, wherein the propellant is initially a solid propellant.

4. A projectile as set forth in claim 1, wherein the propellant is a gaseous propellant.

5. A projectile as set forth in claim 1, wherein is included an explosive charge between the head and the searing agent, the head being expanded under the influence of said explosive charge.

6. A projectile as set forth in claim 1, wherein said propellant is a solid propellent, and wherein is included a launcher having a barrel and a handle, there being a trigger and a set of valves adjacent to the handle, said launcher further including an actuator for enabling the projectile carried by the barrel, said trigger being coupled to the valves to open the valves to allow a discharge of a gas to the solid propellant for igniting the same to thereby cause the launching of a projectile.

7. A projectile as set forth in claim 1, wherein said barrel is of a size sufficient to allow a number of projectiles to be mounted in the barrel in stacked relationship one on top of another in the barrel.

* * * * *